US005359749A

United States Patent [19]

Chu

[11] Patent Number: 5,359,749

[45] Date of Patent: Nov. 1, 1994

[54] PAINT BRUSH WITH REPLACEABLE HEAD

[76] Inventor: Alan C. Chu, 1611 Edgewood Dr., Alhambra, Calif. 91803

[21] Appl. No.: 864,038

[22] Filed: Apr. 6, 1992

[51] Int. Cl.[5] ..... A46B 7/04

[52] U.S. Cl. ..... 15/176.1; 15/202; 15/194; 403/378

[58] Field of Search ..... 15/176.1, 202, 194, 15/145, 244.1, 193, 192; 403/378, 379

[56] References Cited

U.S. PATENT DOCUMENTS

| | | | |
|---|---|---|---|
| 307,519 | 11/1884 | Bintz | 15/194 |
| 993,617 | 5/1911 | Pokorney | 15/176.5 |
| 2,426,418 | 8/1947 | Seaver | 15/194 |
| 2,490,159 | 12/1949 | Ricchiuti | 15/194 |
| 2,629,125 | 2/1953 | Ferguson | 15/202 |
| 2,677,841 | 5/1954 | Tetzlaff | 15/202 |
| 2,732,578 | 1/1956 | Hawkins | 15/202 |
| 2,787,016 | 4/1957 | Carpenter | 15/202 |
| 2,943,341 | 7/1960 | Dant | 15/202 |
| 3,008,165 | 11/1961 | Scholl | 15/176.5 |
| 3,340,557 | 9/1967 | Rosenzweig | 15/202 |
| 3,390,897 | 7/1968 | Moore | 403/379 X |
| 3,544,173 | 12/1970 | Senick et al. | 403/379 X |
| 3,545,551 | 12/1970 | Niemeyer | 403/379 X |
| 4,494,268 | 1/1985 | Chu | 15/176.1 |
| 4,536,037 | 8/1985 | Rink | 403/378 X |

FOREIGN PATENT DOCUMENTS

| | | | |
|---|---|---|---|
| 430709 | 2/1948 | Italy | 15/202 |
| 488169 | 7/1938 | United Kingdom | 15/202 |
| 928579 | 6/1963 | United Kingdom | 15/202 |

*Primary Examiner*—David A. Scherbel
*Assistant Examiner*—Patrick F. Brinson

[57] ABSTRACT

A paint brush with replaceable head comprises a handle (1) and a bristle portion (2) detachably secured to the handle by a removable pin (6). The bristle portion consists of bristles (5) fixedly mounted onto the lower end of a retaining member (4) by adhesives (8).

4 Claims, 1 Drawing Sheet

PAINT BRUSH WITH REPLACEABLE HEAD

BACKGROUND OF THE INVENTION

This invention relates to an improvement for a paint brush described in my U.S. Pat. No. 4,494,269; specifically the using of a headless pin to replace a pair of resilient arms for the mounting of the bristle portion onto the handle of the brush.

SUMMARY OF THE PRESENT INVENTION

In order to improve the technique for the mounting of a detachable bristle portion onto the handle of a paint brush, it is the objective of this invention to provide a paint brush comprising a bristle portion detachably mounted onto the handle by a pin which can be easily removed from or inserted into the brush.

The bristle portion comprises a retaining member in the form of an open tubular body in which bristles or a sponge are fixedly mounted by adhesives at its lower end. A pair of apertures are formed on the opposite walls of the upper end for the passing of the pin.

The handle comprises an elongated bulbous portion connected via a relatively narrow neck to an enlarged connecting chamber in which the bristle portion is removably mounted.

The upper end of the retaining member and the connecting chamber must be fitted into each other perfectly, and with a flange provided either on the retaining member or on the handle for further stabilization. A pair of apertures matched with the pin is also provided on the opposite walls of the connecting chamber for the passing and holding of the pin.

The pin is straight and headless with uniform cross-section of any shape but preferably an oval slot. Unlike other inventions, this pin has been distinctly simplified to eliminate any hook, nail head, hole, notch or threads on its body, and will not need other device to secure it onto the handle. As a result, no paint brush comprising such combination or method has ever existed in the market.

During assembly, the upper end of the bristle portion is first pushed into the connecting chamber on the handle until it is stopped by the flange. The pin is then inserted through both pair of apertures. Since the pin is held in place by apertures formed on the walls of the handle, the result would be stable.

Accordingly, a damaged or permanently soiled bristle portion can be removed by pressing out the pin from the apertures and replaced with a new bristle portion, thus the whole paint brush need not be discarded when the bristle portion is no longer fit for use.

Further objectives and advantages of this invention will become apparent from a consideration of the drawings and ensuing description.

DESCRIPTION OF THE DRAWING FIGURES

DESCRIPTION OF THE ILLUSTRATED EMBODIMENT

Figure 4:
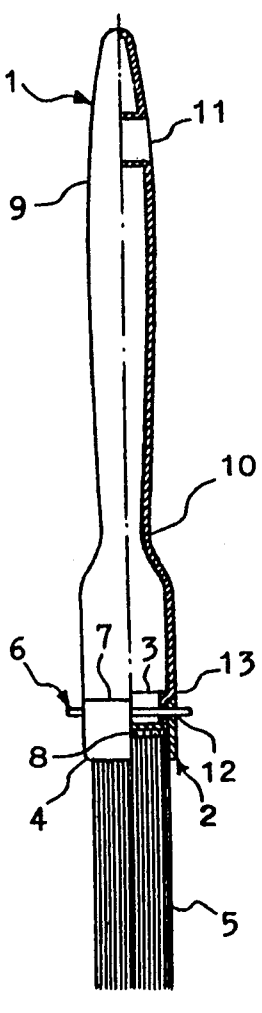
FIG. 4 is the side view of the paint brush whose front view is shown in FIG. 3.

This paint brush comprises a handle (1), a pin (6) and a bristle portion (2) which is detachably mounted onto the connecting chamber (3) of the handle by the pin.

The handle and the pin are preferably moulded from a plastic material or light metal. The pin is normally held by apertures (12) formed on the opposite walls of the connecting chamber due to tight tolerance, but it can also be inserted into or pressed out from either side of the handle without using any tools.

The bristle portion (2) comprises a retaining member (4) preferably made of plastic materials in which the bristles (5) which may be made of a natural or synthetic material including sponge are fixedly mounted.

The retaining member (4) is in the form of an open tubular body of generally rectangular cross-section in which the bristles (5) are fixed by adhesives (8) at the lower end. A pair of apertures are provided on the opposite walls of the upper end (7) for the passing of the pin.

Figure 3:
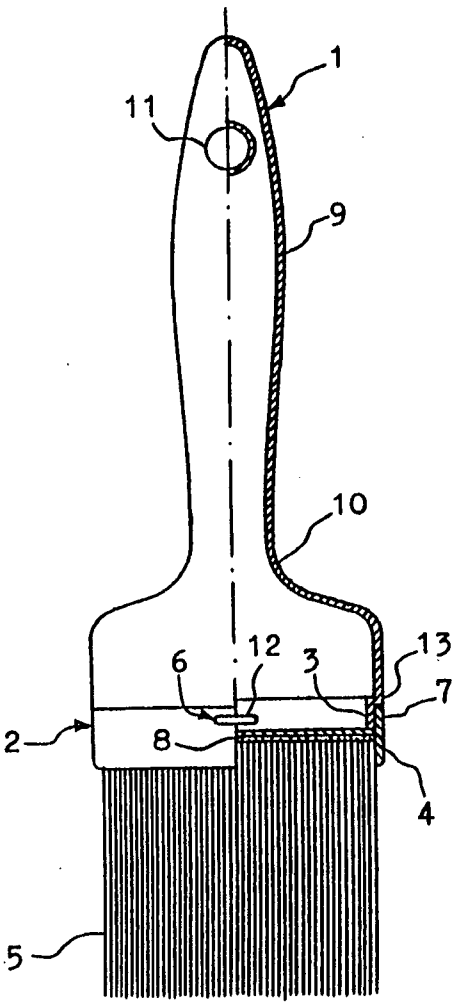
FIG. 3 is the front view of the invention when a flange is formed on the handle.
Figure 2:
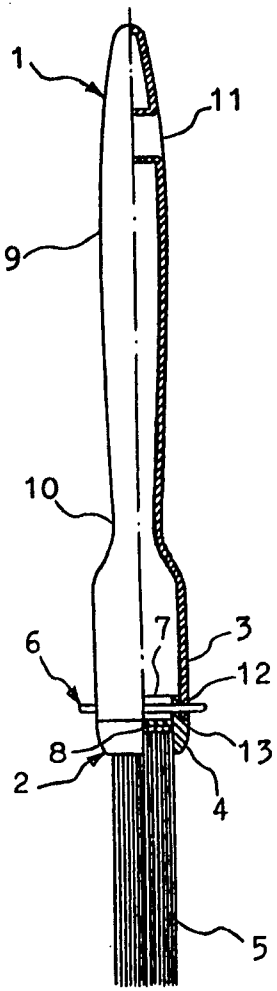
FIG. 2 is the side view of this invention with partially in section to show the inside details.
Figure 1:
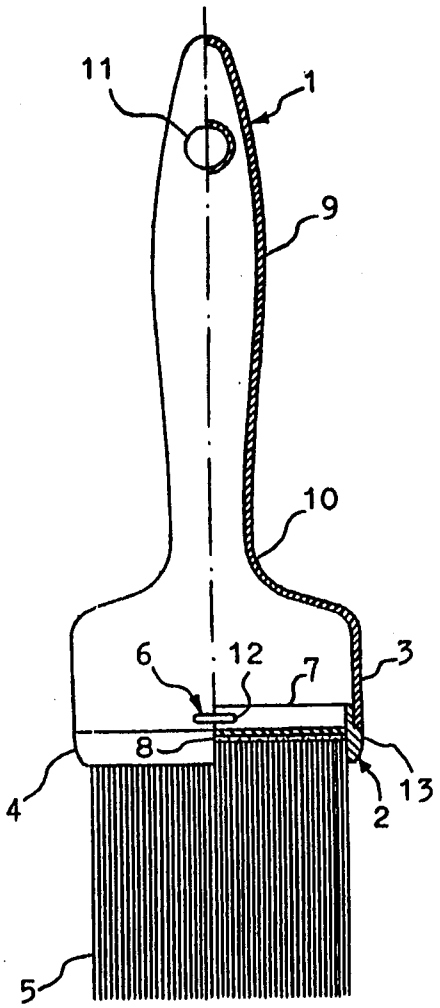
FIG. 1 is the front view of this invention with partially in section to show the inside details.

The handle (1) is formed by an elongate bulbous portion (9) connected via a relatively narrow neck (10) to an enlarged connecting chamber (3) in which the bristle portion is removably mounted. The upper end of the retaining member and the connecting chamber must be fitted into each other perfectly, with flange (13) formed either on the retaining member (as shown in FIG. 1 and FIG. 2) or on the connecting chamber (as shown in FIG. 3 and FIG. 4) for further stabilization.

An aperture (11) may be formed through the free end of the elongate bulbous portion of the handle to allow the handle and any bristle portion mounted thereon to be hung on, for example, a hook in a storage cupboard.

The pin (6) is a straight bar with uniform cross-section of any shape but preferably an oval slot. It carries no hook, nail head, hole, notch or threads on its body and will not need any additional device to secure it on the handle.

During assembly, the upper end (7) of the retaining member is first pushed into the connecting chamber of the handle until it is stopped by the flange (13), the pin is then inserted through both pair of apertures. The bristle portion can be removed from the handle by simply pulling it away after the pin has been lifted out from the apertures.

Although not shown by a picture, the insertion of the pin may be made through its two sides instead of from the front and the back as shown.

I claim:

1. A paint brush comprising:

a handle portion and a bristle portion, said handle portion having a hand gripping portion and a substantially rectangular shaped chamber having opposing side walls attached to one end of said hand gripping portion, and an open end for receiving said bristle portion; said bristle portion having a substantially rectangular shaped bristle retaining member with bristles adhesively attached thereto, said retaining member adapted to be mounted in said chamber, said chamber side walls and said retaining member having a plurality of aligned apertures therethrough; a removable pin means extending through said apertures to retain said retaining member in said chamber; flange means extending around said chamber open end and overlapping said bristles adjacent said retaining member.

2. A paint brush, as recited in claim 1, wherein said pin member is a straight bar with uniform cross-section that frictionally fits into said aligned apertures.

3. A paint brush, as recited in claim 1, wherein said bristles are made of one of the group comprising natural material, synthetic material and sponge.

4. A method of forming a paint brush comprising:

(a) providing a handle having a hand gripping portion and a substantially rectangular shaped chamber having opposing side walls and an open end attached to one end of said hand gripping portion for receiving a bristle portion, said opposing side walls including a pair of apertures and flange means surrounding said chamber open end;

(b) providing a bristle portion having a substantially rectangular shaped bristle retaining member having upper and lower ends with bristles adhesively attached on said lower end and having a pair of apertures in said upper end;

(c) providing a removable pin member;

(d) engaging said bristle retaining member into said handle chamber to abut said flange means thereby aligning said pairs of apertures;

(e) inserting said removable pin member through the pairs of apertures of the handle chamber and bristle retaining member to provide a rigid connection of the two.

* * * * *